US006530149B2

(12) United States Patent
Sugiura et al.

(10) Patent No.: US 6,530,149 B2
(45) Date of Patent: Mar. 11, 2003

(54) METHOD FOR PRODUCING HOLLOW PISTON FOR COMPRESSOR BY FORGING

(75) Inventors: Manabu Sugiura, Kariya (JP); Hidekazu Iwamori, Kariya (JP); Takayuki Kato, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/804,874

(22) Filed: Mar. 13, 2001

(65) Prior Publication Data

US 2001/0022134 A1 Sep. 20, 2001

(30) Foreign Application Priority Data

Mar. 15, 2000 (JP) ..... 2000-071675

(51) Int. Cl.[7] ..... B23P 15/00
(52) U.S. Cl. ..... 29/888.042; 29/888.04
(58) Field of Search ..... 29/888.04, 888.022, 29/888.042; 72/359, 478, 377; 92/260, 172, 186, 155, 159

(56) References Cited

U.S. PATENT DOCUMENTS

| | | | | |
|---|---|---|---|---|
| 5,765,464 A | | 6/1998 | Morita | 92/71 |
| 5,851,320 A | * | 12/1998 | Auran et al. | 148/417 |
| 5,960,542 A | | 10/1999 | Umemura et al. | 29/888.042 |
| 6,205,836 B1 | * | 3/2001 | Yamagata et al. | 72/359 |
| 6,223,701 B1 | * | 5/2001 | Kruse | 123/41.35 |
| 6,266,878 B1 | | 7/2001 | Durkin et al. | 29/888.043 |
| 6,286,414 B1 | * | 9/2001 | Kruse | 123/193.6 |

FOREIGN PATENT DOCUMENTS

| | | |
|---|---|---|
| DE | 974 022 C | 8/1960 |
| DE | 196 20 167 C | 3/1997 |
| EP | 0 896 854 A1 | 2/1999 |
| EP | 0 952 339 A2 | 10/1999 |
| EP | 0 952 342 A2 | 10/1999 |
| EP | 1 058 004 A2 | 12/2000 |
| JP | 58-77736 | 5/1983 |
| JP | 60-168960 | 9/1985 |
| JP | 9-203378 | 8/1997 |
| JP | 09 256952 | 9/1997 |
| JP | 11-294320 | 10/1999 |
| JP | 11-303747 | 11/1999 |
| WO | WO 00/45988 | 8/2000 |

OTHER PUBLICATIONS

EP 01 10 6326 Search Report dated May 2, 2002.

* cited by examiner

*Primary Examiner*—I Cuda Rosenbaum
(74) *Attorney, Agent, or Firm*—Woodcock Washburn LLP

(57) ABSTRACT

A method of producing a hollow piston for a compressor, the piston including a head portion which is slidably fitted in a cylinder bore of the compressor, and an engaging portion which engages a reciprocating drive device of the compressor for reciprocating the piston, at least the head portion of the piston being hollow, the method comprising a step of preparing at least one piston blank by forging, which piston blank includes an engaging-portion-forming section which provides the engaging portion of the piston, and a head-portion-forming section which provides at least a part of the head portion of the piston, the at least one piston blank being prepared by a two-axes forging process which uses a forging die assembly including a set of two first dies which are movable relative to each other along a first axis which is one of two mutually perpendicular axes, and at least one second die which is. movable along a second axis which is the other of the two mutually perpendicular axes. An apparatus for practicing the method is also disclosed.

28 Claims, 9 Drawing Sheets

METHOD FOR PRODUCING HOLLOW PISTON FOR COMPRESSOR BY FORGING

This application is based on Japanese Patent Application No. 2000-071675 filed Mar. 15, 2000, the contents of which are incorporated hereinto by reference.

BACKGROUND OF THE INVENTION

1. Field of the Invention

The present invention relates in general to a method of producing a hollow piston used for a compressor. More particularly, the invention is concerned with a method of producing the hollow piston from a blank which is formed by forging.

2. Discussion of the Related Art

It is desirable to reduce the weight of a piston used for a compressor, since the piston is reciprocated in a cylinder bore of the compressor. For reducing the weight of the piston, the piston has been made hollow. In general, the piston used for the compressor includes a head portion which is slidably fitted in the cylinder bore of the compressor, and an engaging portion which engages a reciprocating drive device for reciprocating the piston. The head portion of such a piston is generally made hollow. The piston having the hollow head portion is produced by preparing a cylindrical body member having an open end and a closed end and including a hollow cylindrical section and a bottom portion, and fixing a closure member to the cylindrical body member for closing its open end. In the piston having the hollow head portion, the engaging portion is formed integrally with the cylindrical body member as disclosed in JP-A-11-294320, or the engaging portion is formed integrally with the closure member as disclosed in JP-A-11-303747.

It is known that a blank for the piston having the hollow head portion is formed by casting or forging. The piston blank wherein the engaging portion is formed integrally with the cylindrical body member cannot be produced by forging. Such a piston blank can be produced by casting. Where the piston blank has the engaging portion integrally with the closure member, the weight of the closure member can be effectively reduced by forming a recess at one of opposite ends of the closure member which is remote from the engaging portion. However, it has been impossible to form this recess by forging.

In general, the piston blank formed by forging has a higher degree of strength than that formed by casting, since the material of the forged piston blank has a higher strength and the forged blank does not have blow holes or shrinkage cavities. Where the piston blank is formed by cold forging, the draft can be made smaller than where the piston blank is formed by casting. Accordingly, the weight of the hollow piston can be easily reduced where the piston is produced from the forged blank. Where the piston blank is formed by casting of an aluminum alloy, a gas is likely to be trapped in the material during the casting. In welding the cylindrical body member and the closure member together, the trapped gas expands to cause a protrusion or recess to be formed in the welded portion of the two members, resulting in reduced bonding strength or deteriorated appearance at the welded portion. In contrast, the piston blank formed by forging avoids such problems. Although it is desirable to form the piston blank by forging, the configuration of the piston blank is inevitably limited when the piston blank is formed by forging.

SUMMARY OF THE INVENTION

It is therefore an object of the present invention to produce a piston blank by forging, with an increased degree of freedom in configuration of the piston blank.

The object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A method of producing a hollow piston for a compressor, the piston including a head portion which is slidably fitted in a cylinder bore of the compressor, and an engaging portion which engages a reciprocating drive device of the compressor for reciprocating the piston, at least the head portion of the piston being hollow, the method comprising a step of preparing at least one piston blank by forging, which piston blank includes an engaging-portion-forming section which provides the engaging portion of the piston, and a head-portion-forming section which provides at least a part of the head portion of the piston, the at least one piston blank being prepared by a two-axes forging process which uses a forging die assembly including a set of two first dies which are movable relative to each other along a first axis which is one of two mutually perpendicular axes, and at least one second die which is movable along a second axis which is the other of the two mutually perpendicular axes.

The method of producing the piston according to the above mode (1) of this invention assures a higher degree of freedom in the configuration of the piston blank to be produced than the conventional method which uses a forging die assembly having forging dies which are movable along only one axis, so that the hollow piston having a reduced weight can be more easily produced according to the present method.

(2) A method according to the above mode (1), wherein the first axis along which the two first dies are moved is perpendicular to an axial direction of the piston blank, while the second axis along which the at least one second die is moved is parallel to the axial direction.

The method according to the above mode (2) is effective to produce the piston blank having concave and convex portions formed or extending in its two mutually perpendicular axes, assuring an improved degree of freedom in the configuration of the piton blank to be produced. Further, the present method permits an easy manufacture of the piston blank having a reduced weight and high strength or durability. Depending upon the configuration of the piston blank to be produced, the two first dies may be moved in the axial direction of the piston blank and the at least one second die may be moved in a direction which is perpendicular to the axial direction of the piston blank.

(3) A method according to the above mode (2), wherein the at least one second die consists of at least one side punch, and the step of preparing the piston blank comprises a step of forming, by forging, the head-portion-forming section by inserting the at least one side punch into an intermediate blank which has been formed by forming the engaging-portion-forming section by forging with the two first dies.

In the method according to the above mode (3), the relative movement of the two first dies along the above-indicated first axis which is perpendicular to the axial direction of the piston blank may take place concurrently with the movement of the side punch along the second axis which is parallel to the axial direction of the piston blank. The method according to the above mode (3), however, permits easy forging of the piston blank having high dimensional and configurational accuracy.

(4) A method according to the above mode (3), wherein the at least one side punch includes a cylindrical portion, and a protruding portion which protrudes from a front end face of the cylindrical portion in the axial direction thereof and which has a non-circular shape in transverse cross section.

In the method according to the above mode (4), there is formed a recess in a part of the head-portion-forming section of the piston blank by the protruding portion of the side punch, so that the piston to be produced has a reduced weight. Although the recess may be formed by a cutting operation, the present method does not require any additional step of cutting the recess. Further, it is in general cumbersome or almost impossible to form a recess having a non-circular shape in transverse cross section by a cutting operation. In contrast, the present method permits the recess having the non-circular shape in transverse cross section to be formed by the protruding portion of the side punch constructed as described above, without the additional step of cutting.

(5) A method according to the above mode (3) or (4), wherein the at least one side punch includes a cylindrical portion, and a protruding portion which protrudes from a front end face of the cylindrical portion and which is offset from the centerline of the cylindrical portion.

The method according to the above mode (5) is effective to reduce the weight of the piston to be produced, and eliminates the additional step of cutting the recess. In general, it is cumbersome to cut the recess in a portion of the head-portion-forming section of the piston blank, which portion is offset from the centerline of the head-portion-forming section. The present method wherein the side punch has the protruding portion formed as described above permits easy formation of the recess in the corresponding portion of the head-portion-forming section of the piston blank.

(6) A method according to the any one of the above modes (3)–(5), wherein the head-portion-forming section includes a cylindrical body portion which has a hollow cylindrical section having an open end and a closed end, and a bottom portion which defines the closed end, and the at least one side punch includes a cylindrical portion having an outer circumferential surface for forming an inner circumferential surface of the cylindrical body portion, and an annular shoulder surface which extends radially outwardly from the outer circumferential surface of the cylindrical portion, for forming an annular end face of the hollow cylindrical section, which end face is remote from the bottom portion.

Where the side punch is constructed to form the annular end face of the hollow cylindrical section which is remote from the bottom portion, as well as the inner circumferential surface of the cylindrical body portion, according to the above mode (6) of the invention, the piston blank does not surfer from any burrs which would otherwise be formed on the end face of the hollow cylindrical section, for thereby eliminating an additional step of removing the burrs. In general, the closure member is fixed to the cylindrical body portion for closing its open end, by welding, bonding or friction welding, with the abutting surface of the closure member being held in close contact with the end face of the cylindrical body portion. If the bur were left on the end face, the abutting surface would not be held in close contact with the end face in the presence of the burr. Prior to the bonding of the abutting surface and the end face together, a machining operation may be effected on the end face to remove the burr therefrom. The present method, however, permits the two members to be fixed together without any clearance formed between the abutting surface and the end face while eliminating the additional step of removing the burr. Accordingly, the present arrangement does not require the machining operation on the end face of the hollow cylindrical section, or at least eliminates the step of removing the burr from the end face.

(7) A method according to the above mode (6), wherein the annular shoulder surface of the at least one side punch has an outside diameter which is larger than that of the annular end face of the hollow cylindrical section.

The annular shoulder surface of the side punch may have an outside diameter which is equal to that of the annular end face of the hollow cylindrical section. In this case, the burr is formed at the radially outer end of the annular end face such that the burr extends therefrom in the axial direction of the cylindrical body portion, or in a direction which is more or less parallel to the axial direction. In this case, the closure member for closing the open end of the cylindrical body portion can be held in close contact at its abutting surface with the annular end face of the hollow cylindrical section without removing the burr from the radially outer end of the annular end face, provided that the abutting surface of the closure member has an outside diameter which is smaller than that of the annular end face. In contrast, where the annular shoulder surface of the side punch has an outside diameter which is larger than that of the annular end face of the hollow cylindrical section according to the above mode (7) of the invention, the burr is formed at the radially outer edge of the annular end face such that the burr extends outwards in a direction parallel to the annular end face, that is, radially outwardly of the hollow cylindrical section. Accordingly, the outside diameter of the abutting surface of the closure member need not be made smaller than that of the annular end face of the hollow cylindrical section in this arrangement. For instance, the outside diameters of the abutting surface of the closure member and the annular end face of the hollow cylindrical section can be made equal to each other.

(8) A method according to the above mode (7), further comprising a step of fixing a closing member to the cylindrical body portion to close the open end of the hollow cylindrical section of the cylindrical body portion, such that the annular end face of the hollow cylindrical section is held in close contact with an end face of the closing member.

(9) A method according to the above mode (8), wherein the closing member includes a fitting portion which extends from the end face thereof, the closing member being fixed to the cylindrical body portion such that the end face of the closing member is held in close contact with the annular end face of the hollow cylindrical section of the cylindrical body member, and such that the fitting portion of the closing member is inserted into the open end of the hollow cylindrical section of the cylindrical body portion.

(10) A method according to any one of the above modes (2)–(9), wherein the engaging portion includes a pair of parallel arm sections which engage opposite surfaces of a swash plate of the reciprocating drive device at a radially outer portion thereof through a pair of shoes, and a base section which connects proximal ends of the arm sections, and the two first, dies are movable toward and away from each other in opposite directions parallel to a direction in which the arm sections extend from the base section.

(11) A method according to the above mode (10), wherein one of the two first dies is a movable die having a forming surface which gives the arm sections and which is movable toward and away from the other of the two first dies which is a stationary die.

(12) A method according to any one of the above modes (1)–(11), wherein the head-portion-forming section which provides at least a part of the head portion of the piston is formed by forging as a cylindrical body portion that gives a principal part of the head portion of the piston.

(13) A method according to any one of the above modes (1)–(11), wherein the head-portion-forming section which provides at least a part of the head portion of the piston is formed by forging as a closure member which closes an open end of a cylindrical body portion that gives a principal part of the head portion of the piston.

(14) A method of producing a blank for a hollow piston used for a compressor, the piston including a head portion which is slidably fitted in a cylinder bore of the compressor, and an engaging portion which engages a reciprocating drive device of the compressor for reciprocating the piston, at least the head portion of the piston being hollow, the method comprising a step of preparing at least one piston blank including an engaging-portion-forming section which provides the engaging portion of the piston, and a head-portion-forming section which provides at least a part of the head portion of the piston, the at least one piston blank being prepared by a two-axes forging process which uses a forging die assembly including a set of two first dies which are movable relative to each other along a first axis which is one of two mutually perpendicular axes, and at least one second die which is movable along a second axis which is the other of the two mutually perpendicular axes.

The method according to the above mode (14) of this invention may have any one of the features included in the above modes (2)–(13).

(15) An apparatus for producing a blank for a hollow piston used for a compressor, the piston including a head portion which is slidably fitted in a cylinder bore of the compressor, and an engaging portion which engages a reciprocating drive device of the compressor for reciprocating the piston, at least the head portion of the piston being hollow, the apparatus comprising a forging die assembly which includes a set of two first dies which are movable relative to each other along a first axis which is one of two mutually perpendicular axes of the blank, and at least one second die which is movable along a second axis which is the other of the two mutually perpendicular axes.

(16) An apparatus according to the above mode (15), wherein the first axis along which the two first dies are moved is perpendicular to an axial direction of the blank, while the second axis along which the at least one second die is moved is parallel to the axial direction, the at least one second die consisting of at least one side punch.

The apparatus according to the above mode (16) of this invention has any one of the features included in the above modes (3)–(13).

(17) An apparatus according to the above mode (16), wherein the forging die assembly further includes a motion converting device for converting a relative movement of the two first dies along the first axis into a movement of the at least one side punch along the second axis.

(18) An apparatus according to the above mode (17), wherein the motion converting device comprises a cam device including a drive cam and a driven cam.

(19) An apparatus according to the above mode (17) or (18), wherein the forging die assembly further comprises at least one of a first die holder for holding one of the two first dies and a second die holder for holding the other of the two first dies, and a hydraulically operated cylinder which is located between the at least one of the first and second die holders and a corresponding one of the two first dies which is held by the at least one die holder, for moving the at least one die holder and the corresponding one of the two first dies relative to each other in a direction parallel to the first axis along which the two first dies are movable relative to each other.

(20) An apparatus according to any one of the above modes 16–19, wherein the forging die assembly further comprises: a first and a second die holder for holding one and the other of the two first dies, respectively, and a motion converting mechanism for converting a relative movement of the first and second die holders toward each other along the first axis, successively into: (a) a movement for positioning a forging blank from which the piston blank is to be produced, with respect to the second axis, by activating the at least one side punch with a force which does not cause deformation of the forging blank; (b) a movement for forging the forging blank with the two first dies to form an intermediate blank, and (c) a movement for inserting the at least one side punch into the intermediate blank so as to form the blank for the hollow piston.

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of the present invention as applied to a single-headed hollow piston for a swash plate type compressor used for an air conditioning system of an automotive vehicle.

Figure 1:
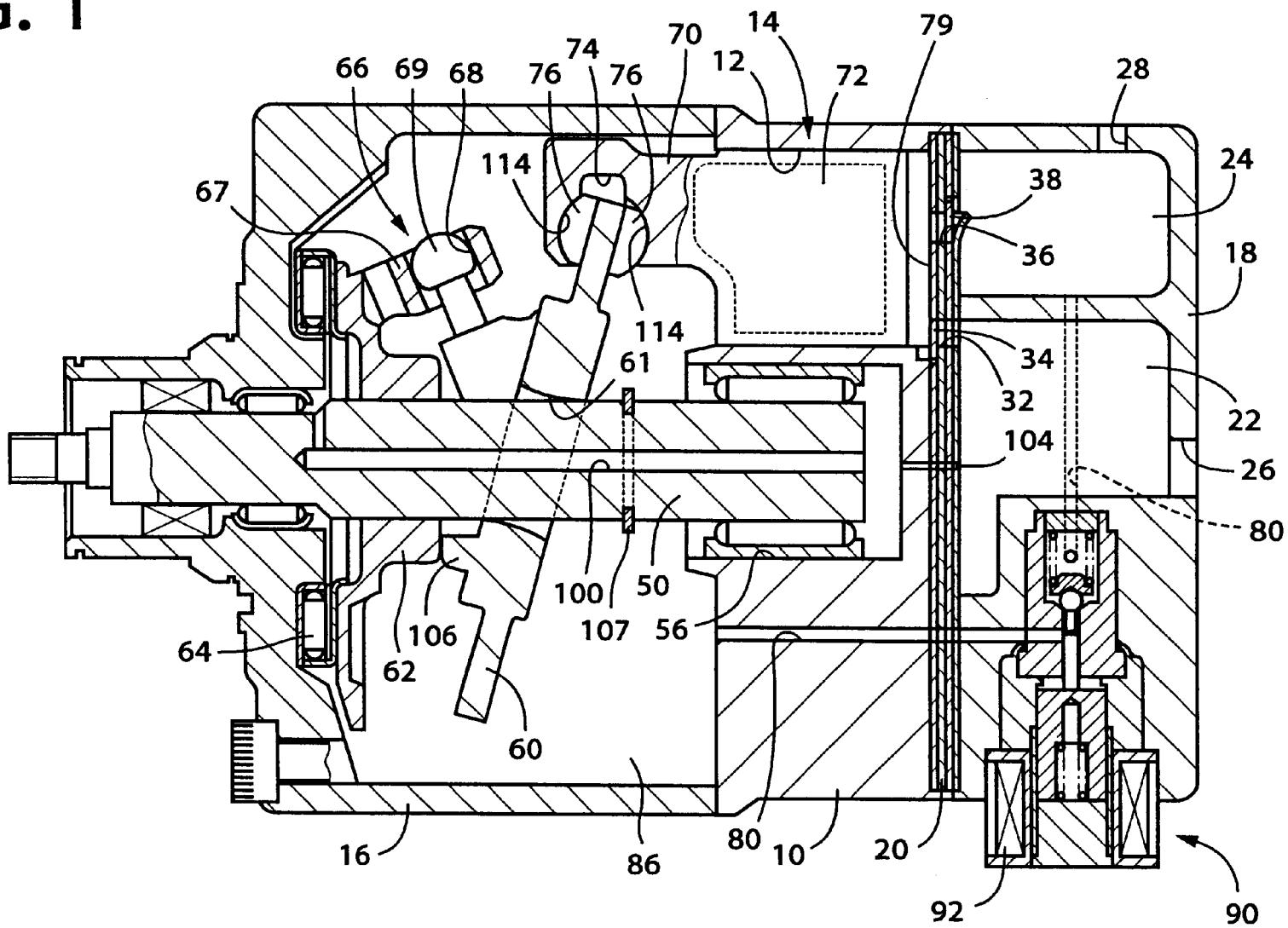
FIG. 1 is a front elevational view in cross section of a swash plate type compressor equipped with a hollow piston produced according to a first embodiment of the present invention.

Referring first to FIG. 1, there is shown a compressor of swash plate type incorporating a plurality of single-headed pistons (hereinafter referred to simply as "pistons") each produced according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. The piston generally indicated at 14 is reciprocably received in each of the cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation of the drive shaft 50 is aligned with the centerline of the cylinder block 10. The drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis.

The rotary drive shaft 50 carries a swash plate 60 such that the swash plate 60 is axially movable and tiltable relative to the drive shaft 50. The swash plate 60 has a central hole 61 through which the drive shaft 50 extends. The diameter of the central hole 61 of the swash plate 60 gradually increases in the axially opposite directions from its axially intermediate portion towards the axially opposite ends. To the drive shaft 50, there is fixed a rotary member 62 as a torque transmitting member, which is held in engagement with the front housing 16 through a thrust bearing 64. The swash plate 60 is rotated with the drive shaft 50 by a hinge mechanism 66 during rotation of the drive shaft 50. The hinge mechanism 66 guides the swash plate 60 for its axial and tilting motions. The hinge mechanism 66 includes a pair of support arms 67 fixed to the rotary member 62, guide pins 69 which are formed on the swash plate 60 and which slidably engage guide holes 68 formed in the support arms 67, the central hole 61 of the swash plate 60, and the outer circumferential surface of the drive shaft 50. It is noted that the swash plate 60 as a drive member, the rotary drive shaft 50, and the torque transmitting device in the form of the hinge mechanism 66 cooperate with one another to constitute a reciprocating drive device for reciprocating the pistons 14.

The piston 14 indicated above includes an engaging portion 70 engaging the swash plate 60, and a head portion 72 formed integrally with the engaging portion 70 and fitted in the corresponding cylinder bore 12. The engaging portion 70 has a groove 74 formed therein, and the swash plate 60 is held in engagement with the groove 74 through a pair of hemispherical shoes 76. The hemispherical shoes 76 are held in the groove 74 such that the shoes 76 slidably engage the engaging portion 70 at their hemi-spherical surfaces and such that the shoes 76 slidably engage the radially outer portions of the opposite surfaces of the swash plate 60 at their flat surfaces. The configuration of the piston 14 will be described in detail.

A rotary motion of the swash plate 60 is converted into a reciprocating linear motion of the piston 14 through the shoes 76. A refrigerant gas in the suction chamber 22 is sucked into the pressurizing chamber 79 through the suction port 32 and the suction valve 34, when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is discharged into the discharge chamber 24 through the discharge port 36 and the discharge valve 38. A reaction force acts on the piston 14 in the axial direction as a result of compression of the refrigerant gas in the pressurizing chamber 79. This compression reaction force is received by the front housing 16 through the piston 14, swash plate 60, rotary member 62 and thrust bearing 64.

The engaging portion 70 of the piston 14 has an integrally formed rotation preventive part (not shown), which is arranged to contact the inner circumferential surface of the front housing 16, for thereby preventing a rotary motion of the piston 14 about its centerline to prevent an interference between the piston 14 and the swash plate 60.

The cylinder block 10 has a supply passage 80 formed therethrough for communication between the discharge chamber 24 and a crank chamber 86 which is defined between the front housing 16 and the cylinder block 10. The supply passage 80 is connected to a capacity control valve 90 provided to control the pressure in the crank chamber 86. The capacity control valve 90 is a solenoid-operated valve having a solenoid coil 92 which is selectively energized and de-energized by a control device (not shown) constituted principally by a computer. During energization of the solenoid coil 92, the amount of electric current applied to the solenoid coil 92 is controlled depending upon the air conditioner load, so that the amount of opening of the capacity control valve 90 is controlled according to the air conditioner load.

The rotary drive shaft 50 has a bleeding passage 100 formed therethrough. The bleeding passage 100 is open at one of its opposite ends to the central bearing hole 56, and is open to the crank chamber 86 at the other end. The central bearing hole 56 communicates at its bottom with the suction chamber 22 through a communication port 104.

The present swash plate type compressor is of variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the crank chamber 86 which acts on the front side of the piston 14 and the pressure in the pressurizing chamber 79 is regulated to change the angle of inclination of the swash plate 60 with respect to a plane perpendicular to the axis of rotation of the drive shaft 50, for thereby changing the reciprocating stroke (suction and compression strokes) of the piston 14, whereby the discharge capacity of the compressor can be adjusted.

Described in detail, the pressure in the crank chamber 86 is controlled by controlling the capacity control valve 90 to selectively connect and disconnect the crank chamber 86 to and from the discharge chamber 24. Described more specifically, while the solenoid coil 92 is in the de-energized state, the capacity control valve 90 is held in its fully open state, and the supply passage 80 is opened for permitting the pressurized refrigerant gas to be delivered from the discharge chamber 24 into the crank chamber 86, resulting in an increase in the pressure in the crank chamber 86, and the angle of inclination of the swash plate 60 is minimized. The reciprocating stroke of the piston 14 which is reciprocated by rotation of the swash plate 60 decreases with a decrease of the angle of inclination of the swash plate 60, so as to reduce an amount of change of the volume of the pressurizing chamber 79, whereby the discharge capacity of the compressor is minimized. While the solenoid coil 92 is in the energized state, the amount of the pressurized refrigerant gas in the discharge chamber 24 to be delivered into the crank chamber 86 is reduced, by increasing an amount of electric current applied to the solenoid coil 92 to reduce (or zero) the amount of opening of the capacity control valve 90. In this condition, the refrigerant gas in the crank chamber 86 flows into the suction chamber 22 through the bleeding passage 100 and the communication port 104, so that the pressure in the crank chamber 86 is lowered, to thereby increase the angle of inclination of the swash plate 60. Accordingly, the amount of change of the volume of the pressurizing chamber 79 is increased, whereby the discharge capacity of the compressor is increased. When the supply passage 80 is closed upon energization of the solenoid coil 92, the pressurized refrigerant gas in the discharge chamber 24 is not delivered into the crank chamber 86, whereby the angle of inclination of the swash plate 60 is maximized to maximize the discharge capacity of the compressor.

The maximum angle of inclination of the swash plate 60 is limited by abutting contact of a stop 106 formed on the swash plate 60, with the rotary member 62, while the minimum angle of inclination of the swash plate 60 is limited by abutting contact of the swash plate 60 with a stop 107 in the form of a ring fixedly fitted on the drive shaft 50. In the present embodiment, the supply passage 80, the crank chamber 86, the capacity control valve 90, the bleeding passage 100, the communication port 104, and the control device for controlling the capacity control valve 90 cooperate to constitute a major portion of an angle adjusting device for controlling the angle of inclination of the swash plate 60 depending upon the pressure in the crank chamber 86 or a discharge capacity adjusting device for adjusting the discharge capacity of the compressor.

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. The cylinder block 10 and the piston 14 may also be formed of an aluminum silicon alloy. Other materials may be used for the cylinder block 10, the piston 14, and the coating film.

There will next be described the configuration of the piston 14.

Figure 2:
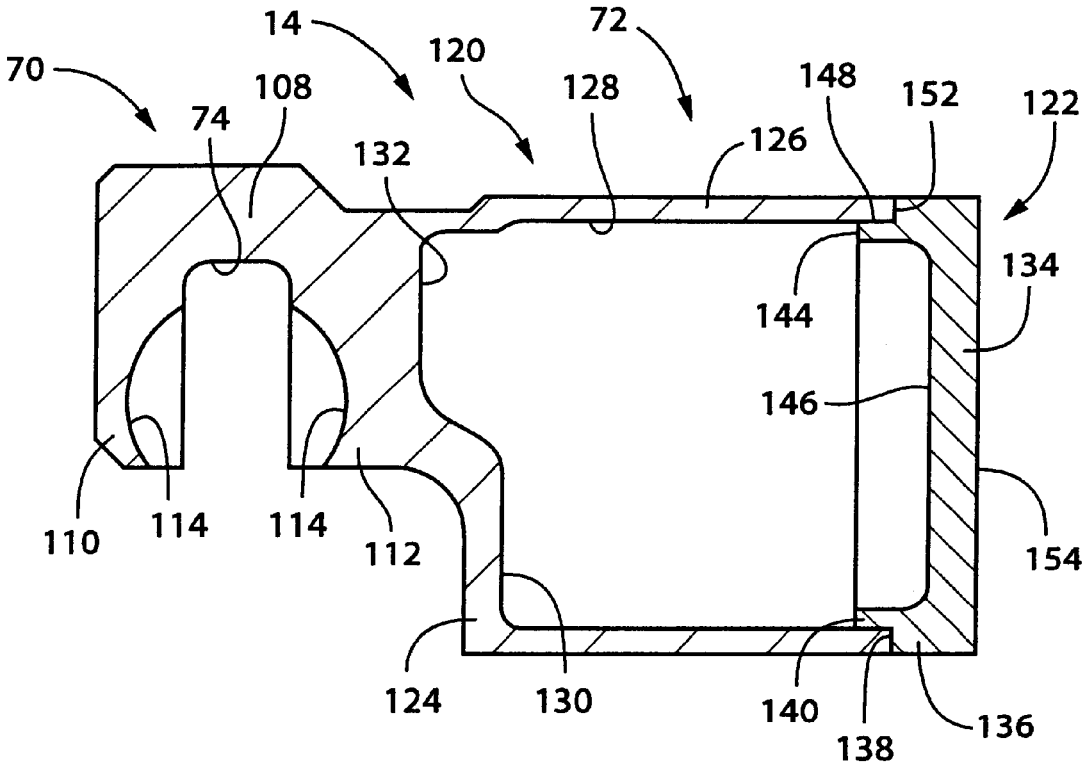
FIG. 2 is a front elevational view in cross section of the piston shown in FIG. 1.

The end portion of the engaging portion 70 of the piston 14, which is remote from the head portion 72, has a U-shape in cross section, as shown in FIG. 2. Described in detail, the engaging portion 70 has a base section 108 which defines the bottom of the U-shape, and a pair of substantially parallel arm sections 110, 112 which extend from the base section 108 in a direction perpendicular to the axis of the piston 14. The base section 108 corresponds to a circumferential portion of the piston 14 which corresponds to a radially outer portion of the cylinder block 10 when the piston 14 is fitted in the appropriate cylinder bore 12. The two opposed lateral walls of the U-shape of the engaging portion 70 have respective recesses 114 which are opposed to each other. Each of these recesses 114 is defined by a part-spherical inner surface of the lateral wall. The pair of shoes 76 indicated above are held in contact with the opposite surfaces of the swash plate 60 at its radially outer portion and are received in the respective part-spherical recesses 114. Thus, the engaging portion 70 slidably engages the swash plate 60 through the shoes 76.

The head portion 72 of the piston 14 is formed integrally with the engaging portion 70 on the side of its arm section 112, and includes a cylindrical body portion 120 which is open at one of its opposite ends on the side remote from the arm section 112 of the engaging portion 70 and is closed at the other end, and an end section in the form of a cap 122 functioning as a closure member fixed to the cylindrical body portion 120 for closing its open end. The closed end of the cylindrical body portion 120 is defined by a bottom portion 124. The cylindrical body portion 120 includes a hollow cylindrical section 126 which extends from a radially outer portion of the bottom portion 124 in the axial direction. The cylindrical body portion 120 has an inner circumferential surface 128 whose diameter is constant over the entire axial length.

The cylindrical body portion 120 of the head portion 72 has an inner bottom surface 130 on the side remote from its open end. The inner bottom surface 130 has a three-dimensional configuration which is nonaxisymmetric with respect to the centerline of the cylindrical body portion 120. Described in detail, the inner bottom surface 130 is formed with a recess 132 at a radially outer portion which is offset from the centerline of the cylindrical body portion 120, and at a circumferential portion which corresponds to the base section 108 of the engaging portion 70, as shown in FIG. 2. In other words, the above-indicated circumferential portion of the inner bottom surface 130 is depressed or recessed toward the arm section 112 in a direction parallel to the centerline of the cylindrical body portion 120. The dimensions of the recess 132, as measured in the directions parallel and perpendicular to the centerline of the cylindrical body portion 120 (in the directions perpendicular and parallel to the direction of extension of the arm sections 110, 112 from the base section 108), are smaller than those of the arm section 112. In the presence of the recess 132, the arm section 112 has a reduced weight.

The cap 122 has a circular bottom plate portion 134, a hollow cylindrical portion 136 extending from a radially outer portion of the circular bottom plate portion 134 in the axial direction of the cap 122, and a hollow cylindrical fitting portion 140 extending from a radially inner portion of an end face 138 of the cylindrical portion 136 in the axial direction. The cap 122 has a recess 146 which is defined by inner circumferential surfaces of the cylindrical portion 136 and the fitting portion 140 and an inner surface of the circular bottom plate portion 134, and which is open in an end face 144 of the fitting portion 140, so that the weight of the cap 122 is reduced. As shown in FIG. 2, there is formed a fillet at a boundary between the inner circumferential surface of the cylindrical portion 136 and the inner surface of the bottom plate portion 134 (i.e., bottom surface of the recess 146), for thereby increasing the rigidity at the boundary. For easier understanding, the thickness of the cylindrical wall thickness of the hollow cylindrical section 126 of the cylindrical body portion 120, the thickness of the cylindrical portion 136 of the cap 122, and the thickness of the bottom plate portion 134 of the cap 122 are exaggerated in FIG. 2.

The cap 122 is fixed to the cylindrical body portion 120 such that an outer circumferential surface 148 of the fitting portion 140 of the cap 122 engages the inner circumferential surface 128 of the cylindrical body portion 120, and such that the end face 138 of the cylindrical portion 136 of the cap 122 engages an annular end face 152 of the cylindrical body portion 120, so that those end faces 138, 152 are welded together. The compression reaction force which acts on an end face 154 of the piston 14 (which is opposite to the end face 144 of the cap 122) as a result of compression of the refrigerant gas in the pressurizing chamber 79 during the compression stroke of the piston 14 is received by the welded portion including the end face 138 of the cylindrical portion 136 of the cap 122 and the annular end face 152 of the cylindrical body portion 120.

Figure 3:
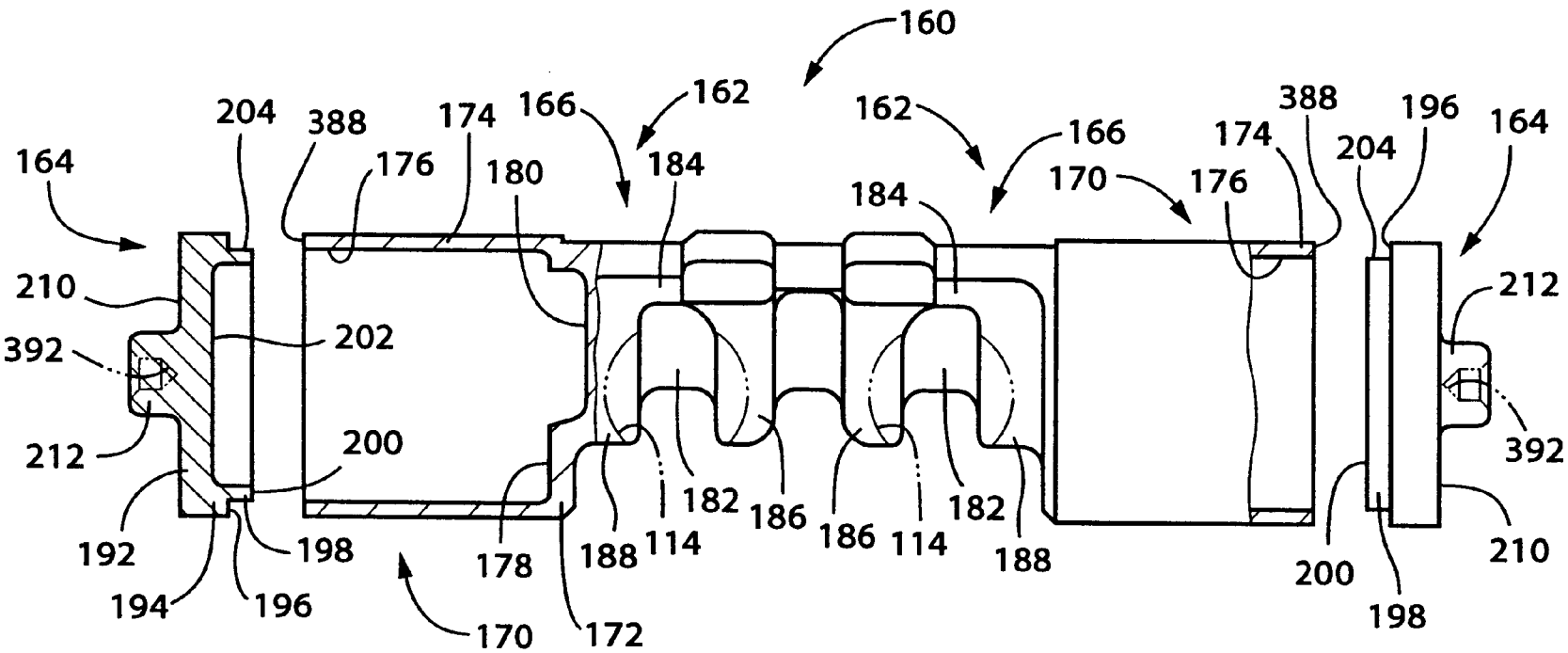
FIG. 3 is a front elevational view partly in cross section showing a blank used for manufacturing the piston of FIG. 2, before a closing member is fixed to each body member of the blank.

Two pieces of the piston 14 constructed as described above are produced from a single blank 160 shown in FIG. 3. The blank 160 used for producing the two pistons 14 has two body members 162 and two closing members 164. Each body member 162 consists of an engaging section 166 and a cylindrical body portion 170 which is formed integrally with the engaging section 166 and which is closed at one of its opposite ends that is on the side of the engaging section 166, and is open at the other end. The two body members 162 are connected to each other at their ends on the side of the engaging sections 166 such that the two cylindrical body portions 170 are concentric with each other. In the present embodiment, the blank 160 provides two pieces of the single-headed piston 14.

The cylindrical body portion 170 of each body member 162 includes a bottom portion 172, and a hollow cylindrical section 174 extending from a radially outer portion of the bottom portion 172 in the axial direction. The cylindrical body portion 170 is formed integrally with the engaging section 166 at its bottom portion 172, and has an inner circumferential surface 176 whose diameter is constant over the entire axial length. The inner circumferential surface 176 of the cylindrical body portion 170 provides the inner circumferential surface 128 of the piston 14. The cylindrical body portion 170 has an inner bottom surface 178 on the side remote from its open end. The inner bottom surface 178 provides the inner bottom surface 130 of the piston 14, and has a three-dimensional configuration which is nonaxisymmetric with respect to the centerline of the cylindrical body portion 170. Described in detail, the inner bottom surface 178 is formed with a recess 180 at a radially outer portion which is offset from the centerline of the cylindrical body portion 170, and at a circumferential portion which corresponds to a base section 184 which gives the base section 108 of the piston 14. In other words, the above-indicated circumferential portion of the inner bottom surface 178 is recessed or depressed toward an arm section 188 of the engaging section 166. As shown in FIG. 3, the engaging section 166 of each body member 162 includes the base section 184 functioning as the base portion 108 of the piston 14 and a pair of opposed parallel arm sections 186, 188 functioning as the arm sections 110, 112 of the piston 14. Reference numeral 182 denotes two bridge portions, each of which connects the inner surfaces of the arm sections 186, 188, in order to reinforce the engaging section 166 for increasing the rigidity of the body member 162, for improved accuracy of a machining operation on the blank 160, which is effected while the blank 160 is held at its opposite ends by chucks as described later, and for preventing the body member 162 from being deformed due to heat. In the present embodiment, the body members 162 are formed by forging of a metallic material in the form of an aluminum alloy. The process of producing the body members 162 will be described in greater detail.

The two closing members 164 are identical in construction with each other as shown in FIG. 3. Like the cap 122 of the piston 14 described above, each closing member 164 includes a circular bottom plate section 192, a hollow cylindrical section 194 which extends from a radially outer portion of the circular bottom plate section 192 in the axial direction of the closing member 164, and a hollow cylindrical fitting section 200 which extends from a radially inner portion of an end face 196 of the cylindrical section 194 in the axial direction. The closing member 164 has a recess 202 which is defined by inner circumferential surfaces of the cylindrical portion 194 and the fitting portion 198 and an inner surface of the circular bottom plate section 192, and which is open in an end face 200 of the fitting section 198, so that the weight of the closing member 164 is reduced. The recess 202 of the closing member 164 provides the recess 146 of the piston 14. The fitting section 198 of the closing member 164 has an outer circumferential surface 204 whose diameter is smaller than that of the cylindrical section 194, so that the fitting section 198 of the closing member 164 is fitted in the cylindrical body portion 170 such that the outer circumferential surface 204 of the fitting section 198 of the closing member 164 engages the inner circumferential surface 176 of the cylindrical body portion 170. The circular bottom plate section 192 of each closing member 164 has a holding portion 212 formed at a central portion of its outer end face 210 which is remote from the end face 200 of the fitting section 198. The holding portion 212 has a circular shape in cross section. Like the body member 162, the closing member 164 in the present embodiment is formed by forging of a metallic material in the form of an aluminum alloy.

Figure 4:
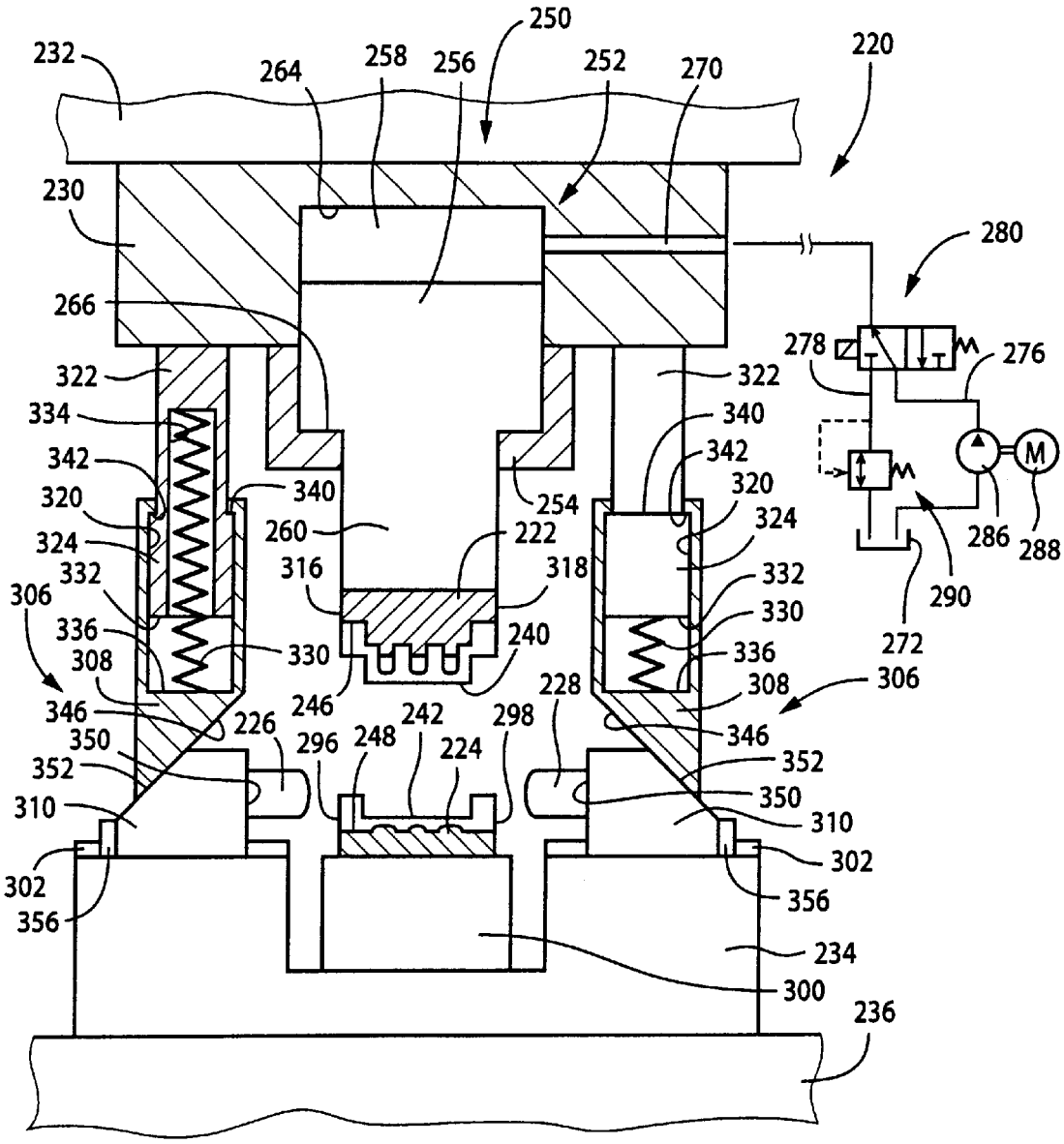
FIG. 4 is a front elevational view in cross section showing a forging die assembly used for producing a piston blank from which the piston of FIG. 2 is produced.

Referring next to FIG. 4, there is shown a forging die assembly which is a major portion of a forging apparatus used in the present embodiment, for producing the body members 162.

The forging die assembly generally denoted by a reference numeral 220 in FIG. 4 includes a first die 222 and a second die 224 which are movable relative to each other in opposite directions toward and away from each other, and a pair of side punches 226, 228. The first die 222 is held by a first die holder 230 and is removably attached to a movable platen 232, while the second die 224 is held by a second die holder 234 and is removably attached to a stationary platen 236. The movable platen 232 is moved toward and away from the stationary platen 236 by a drive device in the form of a vertically reciprocating device not shown. Thus, the first die 222 functions as a movable die while the second die 224 functions as a stationary die.

The first and second dies 222, 224 are butted together at respective contacting surfaces 240, 242 which define parting planes. The first and second dies 222, 224 have respective forming surfaces 246, 248 which cooperate with each other to define a cavity having a configuration which follows that of the two body members 162. The longitudinally opposite end portions of the contacting surfaces 240, 242 lie on a horizontal plane which includes the centerlines of the cylindrical body portions 170, and the longitudinally intermediate portions of the contacting surfaces 240, 242 lie on a horizontal plane which is perpendicular to the direction of extension of the arm sections 186, 188 from the base sections 184 and which passes the centers of the wall thickness of the base sections 184 (as measured in the above-indicated direction of extension). The forming surface 246 of the first die 222 has a configuration which corresponds to those of the arm sections 186, 188 and a part of the base sections 184 on the side of the arm sections 186, 188. The forming surface 248 of the second die 224 has a configuration which corresponds to those of the other part of the base sections 184 on the side opposite to the arm sections 186, 188. The first die 222 is movable toward and away from the second die 224 in the opposite directions parallel to a diametric direction of the cylindrical body portions 170 which is parallel to the direction of extension of the arm sections 186, 188.

As shown in FIG. 4, a hydraulic cylinder 250 is interposed between the first die holder 230 and the first die 222. The hydraulic cylinder 250 includes a housing 252 which is defined by a part of the first die holder 230 which has a recess, and a hollow cylindrical member 254 fixed to the first die holder 230. The hydraulic cylinder 250 further includes a piston 256 which is carried by a piston rod 260 and which is slidably and fluid-tightly received in the housing 252. The piston 256 and the housing 252 cooperate with each other to define a fluid chamber 258. The piston rod 260 which projects from the housing 252 carries the first die 222 at its free end which is remote from the piston 256. The retracting movement of the piston 256 is limited by abutting contact of one of its opposite end faces with a bottom surface 264 of the recess formed in the first die holder 230, which bottom surface 264 partially defines the fluid chamber 258, while the advancing movement of the piston 256 is limited by abutting contact of the other end face of the piston 256 with a shoulder 266 of the hollow cylindrical member 254.

The fluid chamber 258 of the hydraulic cylinder 250 is connected via a fluid passage 270 to a fluid reservoir 272 which stores a working fluid. The fluid passage 270 is divided into a fluid supply line 276 and a fluid discharge line 278. A solenoid-operated directional control valve 280 as a control valve device for controlling the hydraulic cylinder 250 is provided between the fluid passage 270 and the supply and discharge lines 276, 278. The solenoid-operated directional control valve 280 has a solenoid coil which is selectively de-energized and energized so as to selectively connect the fluid passage 270 to the supply line 276 for supplying the working fluid from the fluid reservoir 272 to the fluid chamber 258, or to the discharge line 278 for discharging the working fluid from the pressure chamber 258 into the fluid reservoir 272. To the supply line 276, there is connected a pump 286 and a motor 288 for driving the pump 286. While the solenoid coil of the directional control vale 280 is in the de-energized state, the working fluid received from the fluid reservoir 272 is pressurized by the pump 286 upon activation of the motor 288, and the pressurized fluid is fed to the fluid chamber 258 through the supply line 276 and the fluid passage 270. The delivery pressure of the pump 286 is regulated by a pressure relief valve (not shown) provided in parallel with the pump 286. To the discharge line 278, there is connected a pressure relief valve 290. When the pressure in the fluid chamber 258 becomes higher than a predetermined threshold value while the solenoid coil of the directional control valve 280 is in the energized state, the pressure relief valve 290 is opened, so that the working fluid in the fluid chamber 258 is discharged therefrom into the fluid reservoir 272 via the fluid passage 270 and the discharge line 278.

The side punch 226 is located adjacent to a side surface 296 of the second die 224, while the side punch 228 is located adjacent to a side surface 298 of the second die 224. The two side punches 226, 228 are held by the second die holder 234 such that the side punches 226, 228 are movable toward and away from each other. The second die 224 is held by the second die holder 234 via a center plate 300. The side punches 226, 228 are moved relative to each other in opposite two axial directions which are perpendicular to the direction of movement of the first die 222 and which are parallel to the axial direction of the cylindrical body portion 170 of each body member 162. The side punches 226, 228 are guided by respective guide rails 302 provided on the second die holder 234.

The side punches 226, 228 are moved toward and away from each other by respective motion converting devices in the form of cam devices 306. The cam devices 306 convert the movement of the movable platen 232 toward and away from the stationary platen 236 into respective movements of the side punches 226 228 relative to each other in the opposite axial directions. Each cam device 306 includes a drive cam 308 and a driven cam 310. The drive cam 308 is a generally cylindrical member having a bore 320 in which a rod member 322 is slidably and unrotatably received. The rod member 322 of each cam device 306 extends from the first die holder 230 toward the second die holder 234 with a predetermined spacing from a corresponding one of the side surfaces 316, 318 of the first die 222. The rod member 322 has, at its free end remote from the first die holder 230, a head portion 324 having a larger diameter than the other portion, for thereby limiting a relative movement of the rod member 322 and the drive cam 308 away from each other. Between the head portion 324 of the rod member 322 and the drive cam 308, there is interposed a biasing means in the form of a compression coil spring 330 which is an elastic member. The compression coil spring 330 is supported at one of its opposite ends by a bottom surface of an axial hole 334 which is formed in the rod member 322 and is open to an end face 332 of the head portion 324, and at the other end by a bottom surface 336 of the bore 320 of the drive cam 308. With a preload acting on the compression coil spring 330, the head portion 324 is held, at its shoulder surface 340 opposite to its end face 332, in abutting contact with a shoulder surface 342 of the drive cam 308, which shoulder surface 342 is adjacent to the open end of the bore 320. The drive cam 308 and the rod member 322 move as a unit before the drive cam 308 receives a force which is larger than the preload of the compression coil spring 330. Each drive cam 308 has at its free end remote from the rod member 322 an inclined surface 346. The inclined surface 346 of each of the two drive cams 308 is inclined such that a distance between the inclined surfaces 346 of the two drive cams 308 increases with a decrease of a distance between each inclined surface 346 and the top surface of the second die holder 234.

The two driven cams 310 are disposed under the respective drive cams 308, and have the side punches 226, 228, respectively. Each of the driven cams 310 has a front surface 350 from which the corresponding side punch 226, 228 projects, and a rear inclined surface 352 which is inclined in the same direction as the inclined surface 346 of each drive cam 308. The inclined surface 346 of each drive cam 308 and the inclined surface 352 of the corresponding driven cam 310 are located adjacent to or held in contact with each other. As the drive cams 308 are moved downward toward the second die holder 234, the driven cams 310 are moved while being guided by the respective guide rails 302, whereby the side punches 226, 228 of the respective driven cams 310 are moved in the opposite axial directions toward each other. While each driven cam 310 is in the non-activated state, the driven cam 310 is biased by an elastic spring (not shown) as a biasing means, such that the driven cam 310 is positioned in its fully retraced position defined by a stop 356. This elastic spring functions as retracting means for retracting each side punch 226, 228 to its fully retracted position, and is given a preload which is smaller than that of the compression coil spring 330 described above. The retracting means for retracting each side punch 226, 228 may be constituted by a fluid-actuated cylinder in the form of a hydraulic cylinder which is disposed between the driven cam 310 and the second die holder 234.

Figure 5:
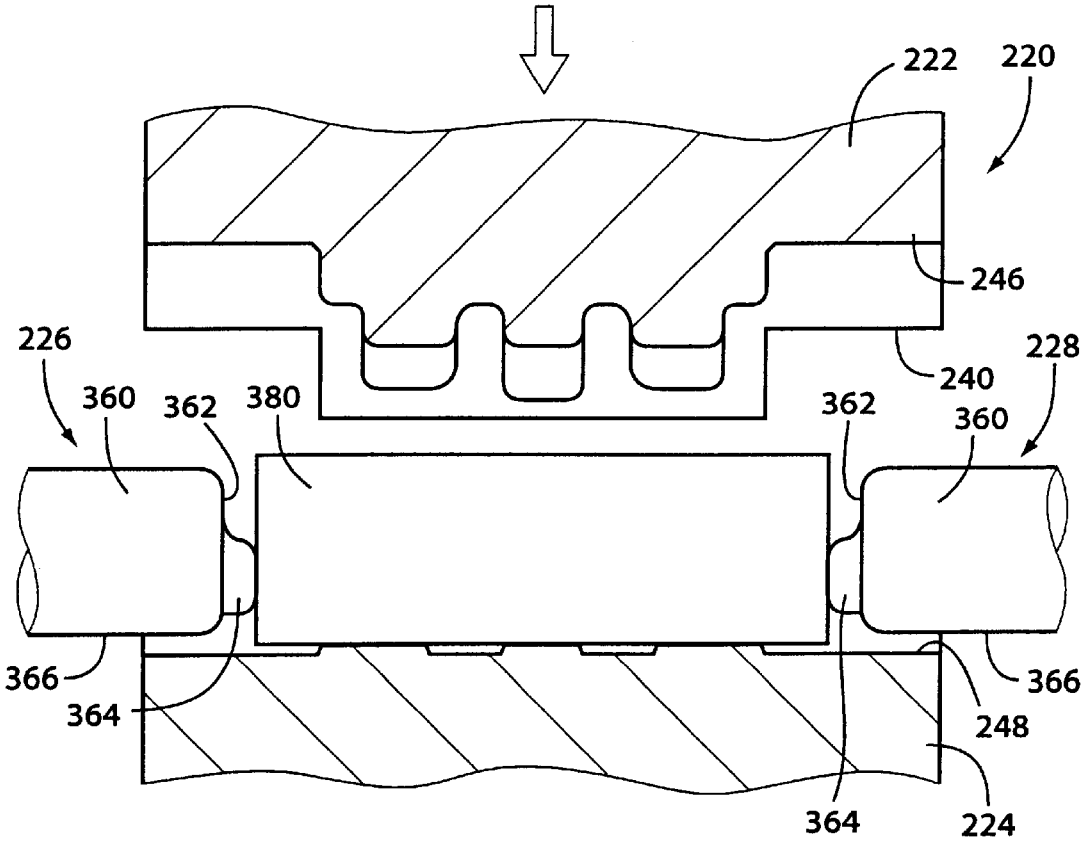
FIG. 5 is a front elevational view in cross section explaining a process of producing the piston blank of FIG. 3.

As shown in FIG. 5, each of the side punches 226, 228 includes a cylindrical portion 360, and a protruding portion 364 which has a non-circular shape in cross section and which protrudes from a predetermined circumferential portion of a front end face 362 of the cylindrical portion 360, which circumferential portion is offset from the centerline of the cylindrical portion 360. Accordingly, each side punch 226, 228 has a nonaxisymmetric configuration which corresponds to that of the inner bottom surface 178 of the cylindrical body portion 170 of each body member 162 of the piston blank 160. The cylindrical portion 360 of each side punch 226, 228 has an outer circumferential surface 366 whose diameter is equal to that of the inner circumferential surface 176 of the cylindrical body portion 170. The protruding portion 364 of each side punch 226, 228 protrudes from the above-indicated circumferential portion of the front end face 362 of the cylindrical portion 360, which circumferential portion is offset from the centerline of the cylindrical body portion 170 and which corresponds to the recess 180 of the bottom portion 172 (the base section 184 of the engaging section 166). The protruding portion 364 extends in the direction parallel to the centerline of the cylindrical body portion 170.

The two body members 162 are formed by cold forging, using the forging die assembly 220 constructed as described above.

Initially, a forging blank 380 of an aluminum alloy is placed on the forming surface 248 of the second die 224. A pressurized fluid is supplied to the fluid chamber 258 of the hydraulic cylinder 250, whereby the piston 256 is moved to its advanced position in which the piston 256 is held in abutting contact with the shoulder 266 of the hollow cylindrical member 254. In this state, the movable platen 232 is moved by the vertically reciprocating device toward the stationary platen 236, so that the first die 222 is moved toward the second die 224. At the same time, each rod member 322 and each drive cam 308 are moved as a unit toward the second die holder 234, whereby the side punches 226, 228 of the respective driven cams 310 are moved toward each other so that the forging blank 380 is clamped therebetween. Thus, the forging blank 380 is axially positioned by the side punches 226, 228.

After the forging blank 380 has been clamped by and between the side punches 226, 228, elastic deformation of the compression coil spring 330 is initiated, permitting the rod member 322 to be moved relative to the driven cam 310. The force by which the side punches 226, 228 press the forging blank 380 is equal to a difference between the biasing force of the compression coil spring 330 and the biasing force of the elastic spring which biases the driven cam 310 in its fully retracted position, if the angle of inclination of the inclined surface 346 of each drive cam 308 is 45 degrees. This pressing force of the side punches 226, 228 which acts on the forging blank 380 is determined such that the forging blank 380 clamped by and between the side punches 226, 228 is not deformed. The positioning of the forging blank 380 between the side punches 226, 228 may be otherwise effected. For instance, each driven cam 310 may be adapted to stop just before the side punches 226, 228 contact the forging blank 380, by abutting contact with a stop device which includes an elastic member and which is given a predetermined preload. In this state, the forging blank 380 is axially positioned by and between the side punches 226, 228. The stop device needs to be retracted upon receiving a force larger than its preload, for permitting the advancing movement of the driven cam 310.

Figure 6A:
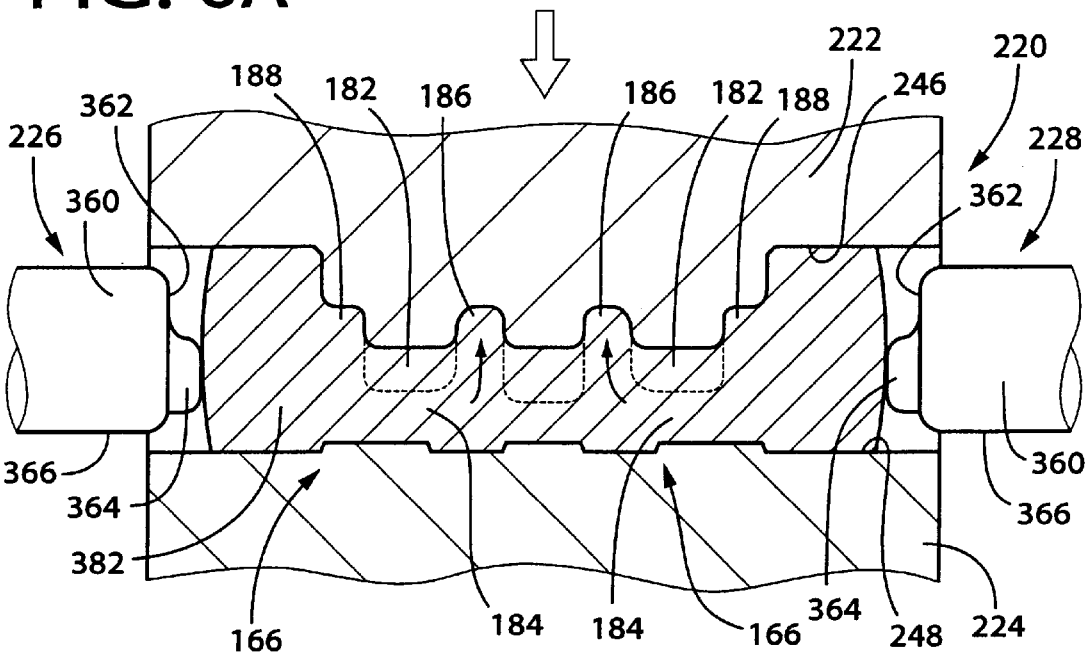
FIGS. 6A and 6B are front elevational views in cross section explaining another process for producing the piston blank of FIG. 3.

After the forging blank 380 has been axially positioned by and between the side punches 226, 228, the projecting central portion of the forming surface 246 of the first die 222 is brought into contact with the upper surface of the forging blank 380, so that the forging operation on the blank 380 is initiated. As the forging blank 380 is forged between the first and second dies 222, 224 for forming the engaging sections 166, the forging blank 380 is deformed such that the axial dimension of the blank 380 increases. This increase of the axial dimension of the blank 380 is permitted by the retracting movement of each side punch 226, 228 away from the blank 380. When the first and second dies 222, 224 are butted together at their contacting surfaces 240, 242, the two engaging sections 166, each of which includes the arm sections 186, 188 and the base section 184, are formed between the forming surfaces 246, 248 of the first and second dies 222, 224, as shown in FIG. 6A.

Figure 6B:
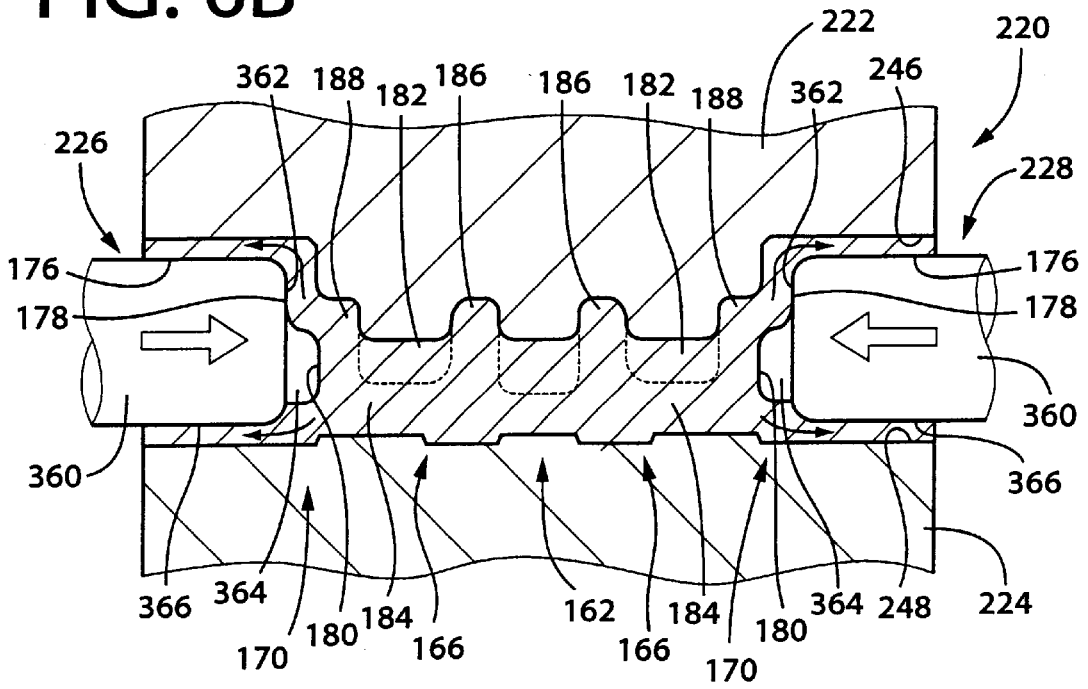

After the two engaging sections 166 have been formed as described above, the end face 332 of the head portion 324 of each rod member 322 comes into contact with the bottom surface 336 of the bore 320 of the drive cam 308. Accordingly, the drive cams 308 are moved together with the movable platen 232 for advancing the driven cams 310, so that the side punches 226, 228 are inserted into an intermediate blank 382 on which the two engaging sections 166 have been formed and which is clamped by and between the first and second dies 222, 224. Thus, the respective cylindrical body portions 170 are formed by the side punches 226, 228, as shown in FIG. 6B. The first die 222 which is held in abutting contact with the second die 224 must be moved relative to the first die holder 230 during the movement of the movable platen 232 toward the stationary platen 236. To this end, the solenoid-operated directional control valve 280 is placed in the energized state for permitting the working fluid to be discharged from the fluid chamber 258, for thereby permitting the piston 256 and the first die 222 to be moved relative to the first die holder 230. The discharge flow of the working fluid from the fluid chamber 258 is controlled by the pressure relief valve 290 provided in the discharge line 278, such that the fluid pressure in the fluid chamber 258 is kept at a predetermined level which permits the intermediate blank 382 to be held by and between the first and second dies 222, 224. The solenoid-operated directional control valve 280 may be placed in the energized state either before or after the first and second dies 222, 224 have been butted together.

As described above, the side punches 226, 228 are inserted into the intermediate blank 382 as shown in FIG. 6B, whereby the cylindrical body portions 170 are formed. Namely, the inner circumferential surfaces 176 of the cylindrical body portions 170 are given by the outer circumferential surfaces 366 of the cylindrical portions 360 of the respective side punches 226, 228, and the inner bottom surfaces 178 and the recesses 180 of the cylindrical body portions 170 are given by the front end faces 362 and the protruding portions 364 of the respective side punches 226, 228. The formation of the cylindrical body portions 170 by the side punches 226, 228 is completed when the piston 256 of the hydraulic cylinder 250 has been brought into abutting contact with the bottom surface 264 of the fluid chamber 258. The formation of the cylindrical body portions 170 may be terminated by stopping the advancing movement of the movable platen 232 at its lower end position while permitting the operating stroke of the piston 256 to be large enough to allow the side punches 226, 228 to be inserted into the intermediate blank 382 for forming the cylindrical body portions 170.

When the two body members 162 are formed integrally with each other upon completion of the formation of the cylindrical body portions 170, the solenoid-operated directional control valve 280 is placed in the de-energized state, for thereby, supplying the working fluid from the fluid reservoir 272 to the fluid chamber 258 via the supply line 276 and the fluid passage 270. Subsequently, the movable platen 232 is moved upward away from the stationary platen 236. During the upward movement of the movable platen 232, the first die 222 is kept pressed against the body members 162 since the working fluid is kept supplied to the fluid chamber 258 of the hydraulic cylinder 250, so that the body members 162 are held by and between the first and second dies 222, 224. In the meantime, each rod member 322 is moved upward so that the end face 332 of its head portion 324 is moved away from the bottom surface 336 of the bore 320 formed in the drive cam 308, and the corresponding drive cam 308 is moved upward together with the corresponding rod member 322. As a result of the upward movement of the drive cams 308 and the rod members 322, the driven cams 310 are retracted together with the respective side punches 226, 228 under the biasing force of the elastic spring not shown, whereby the side punches 226, 228 are moved out of the cylindrical body portions 170. Since the body members 162 are held by and between the first and second dies 222, 224, the body members 162 are prevented from moving together with the side punches 226, 228, facilitating the removal of the side punches 226, 228 away from the cylindrical body portions 170. Subsequently, the first die 222 is moved away from the second die 224, and the body members 162 are removed from the second die 224.

There will be next explained a process of fixing each closing member 164 to the corresponding body member 162.

Since the inner circumferential surface 176 and the inner bottom surface 178 of the cylindrical body portion 170 of each body member 162 formed by the cold forging described above have a high degree of dimensional accuracy, the body member 162 and the closing member 164 can be fixed together without those surfaces 176, 178 being subjected to any machining operation such as cutting or grinding. The fitting section 198 of each closing member 164 is inserted into the open end part of the corresponding cylindrical body portion 170 with axes of the closing member 164 and the cylindrical body portion 170 being aligned with each other, such that the outer circumferential surface 204 of the fitting section 198 engages the inner circumferential surface 176 of the cylindrical body portion 170. With the closing member 164 being radially positioned relative to the cylindrical body portion 170 by the engagement of those inner and outer circumferential surfaces 176, 204, the closing member 164 is inserted into the cylindrical body portion 170 such that the end face 196 of the closing member 164 is held in abutting contact with the annular end face 388 of the hollow cylindrical section 174 of the cylindrical body portion 170. These end faces 388, 196 are welded to each other by means of beam welding such as an electron beam or a laser beam.

After the two closing members 164 are fixedly fitted in the open end portions of the respective body members 162 as described above, a machining operation is performed on the outer circumferential surfaces of the hollow cylindrical sections 174 which give the head portions 72 of the two pistons 14, respectively, and the exposed outer circumferential surfaces of the closing members 164. This machining operation is effected on a lathe or turning machine such that the blank 160 is held by chucks at the holding portions 212 of the closing members 164, with the blank 160 being centered with two centers engaging the center holes 392 (each of which is indicated by a two-dot chain line in FIG. 3) of the holding portions 212, and such that the blank 160 (i.e., an assembly of the two body members 162 and the two closing members 164) is rotated by a suitable rotary drive device through the chucks. The machining operation is effected on the outer circumferential surfaces of the cylindrical body portions 170 and the closing members 164.

Then, the outer circumferential surfaces of the cylindrical body portions 170 of the body members 162 and the closing members 164 are coated with a suitable material, such as a film of polytetrafluoroethylene. The blank 160 is then subjected to a machining operation to cut off the holding portions 212 from the outer surfaces 210 of the closing members 164, and a centerless grinding operation on the coated outer circumferential surfaces of the cylindrical body portions 170 and the closing members 164, so that the two portions which provide the head portions 72 of the two pistons 14 are formed.

In the next step, a cutting operation is performed near the bridge portions 182 of each engaging section 166, to form the recesses 114 (indicated by a two-dot chain line in FIG. 3) in which the shoes 76 of the piston 14 are received. Thus, the two portions which provide the engaging portions 70 of the two pistons 14 are formed. Finally, the blank 160 is cut into two pieces which provide the respective two single-headed pistons 14.

As is apparent from the above description, each body member 162 constitutes a piston blank which includes the engaging-portion-forming section (the engaging section 166) and the head-portion-forming section (the cylindrical body portion 170) which gives at least a part of the head portion 72 of the piston 14. The first and second dies 222, 224 function as the set of two first dies which are movable relative to each other along the first axis which is one of the two mutually perpendicular axes, while the side punches 226, 228 function as the at least one second die which is movable along the second axis which is the other of the two mutually perpendicular axes.

In the present embodiment, the inner circumferential surfaces 176 and the inner bottom surfaces 178 of the cylindrical body portions 170 of the body members 162 are formed by the side punches 226, 228, without requiring any additional step of machining on those surfaces 176, 178. Accordingly, the method according to the present embodiment facilitates the manufacture of the piston 14 and reduces the cost of its manufacture. Since the piston blank formed by forging has a higher degree of strength than the piston blank formed by casting, the cylindrical wall thickness of the hollow cylindrical section 174 of the cylindrical portion 170 of each body member 162 can be reduced while permitting the formed piston 14 to have a sufficiently high degree of strength, so that the piston 14 has a reduced weight. According to the present arrangement, the recess 180 is formed by the protruding portion 364 of each side punch 226, 228 at a radially outer portion and a circumferential portion of the inner bottom surface 178 of the cylindrical body portion 170 corresponding to the base portion 184, so as to reduce the weight of the head portion at the circumferential portion of the inner bottom surface 178, which circumferential portion could not be conventionally subjected to a machining operation using a cutting tool for reducing the weight of the head portion.

Figure 7:
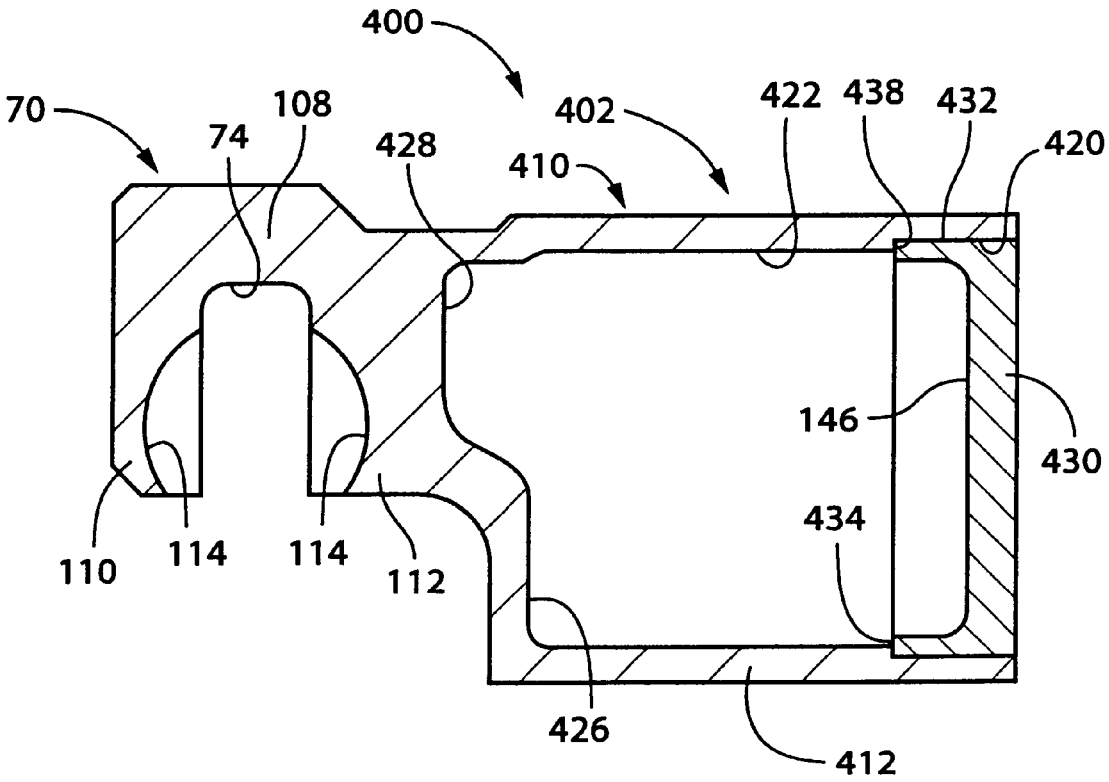
FIG. 7 is a front elevational view in cross section of a piston produced according to a second embodiment of the invention.

The configuration of the side punch is not limited to that of the side punches 226, 228 shown in FIG. 5. FIG. 7 shows a single-headed piston 400 constructed according to a second embodiment of the present invention by using side punches different from those used in the above-described first embodiment. The side punch used for producing the piston 400 has a cylindrical portion having a larger diameter at one of its opposite ends which is remote from the protruding portion formed on its front end face. The piston 400 produced by using the thus constructed side punch has a cylindrical body portion 410 which gives a principal part of its head portion 402 and whose inner circumferential surface is divided into a large-diameter section 420 on the side of its open end, and a small-diameter section 422, as shown in FIG. 7. Like the recess 180 formed in the inner bottom surface 178 of the cylindrical body portion 170 of the body member 162 in the above-described first embodiment, a recess 428 is formed in a bottom surface 426 of the cylindrical body portion 410 at a radially outer portion which is offset from the centerline of the cylindrical body portion 410, and at a circumferential portion which corresponds to the base section 108 of the engaging portion 70. Accordingly, the weight of the piston 400 is effectively reduced. In the present embodiment, the inner circumferential surface of the cylindrical body portion 410 engages, at its large-diameter section 420, an outer circumferential surface 432 of a cap 430, without effecting the machining operation on the inner circumferential surface (including the large- and small-diameter sections 420, 422) of the cylindrical body portion 410, and the inner bottom surface 426, or with a reduced number of machining steps. The cap 430 is fixed to the cylindrical body portion 410 such that its end face 434 is held in abutting contact with a shoulder surface 438 formed between the large- and small-diameter sections 420, 422 of the inner circumferential surface of the cylindrical body portion 410. The cylindrical body portion 410 and the cap 430 are fixed together at their contacting surfaces 420, 432 by welding or bonding.

Figure 8:
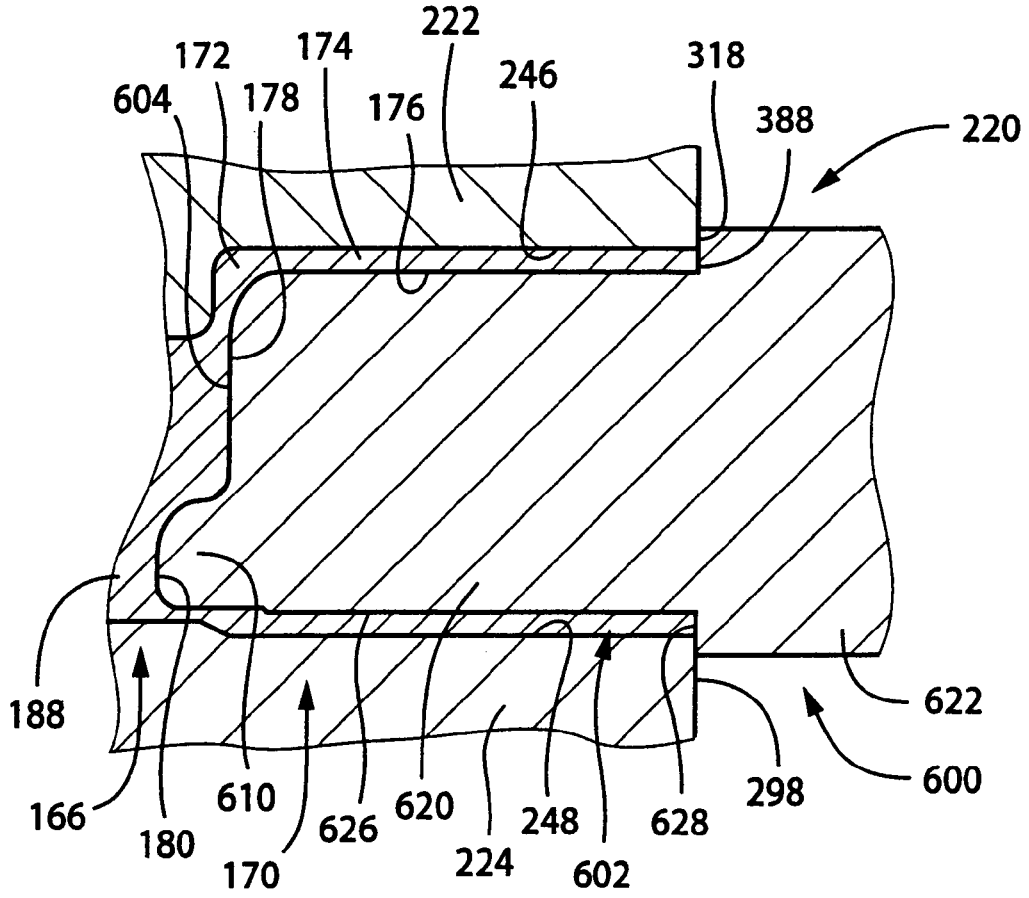
FIG. 8 is a front elevational view in cross section explaining a process step for producing a piston blank to form a piston according to a third embodiment of the invention.

In addition to the inner circumferential surface 176 and the inner bottom surface 178 of the cylindrical body portion 170 of each body member 162, the annular end face 388 of the cylindrical body portion 170 on the side of its open end may be formed by each side punch. FIG. 8 shows a side punch 600 constructed according to a third embodiment of the present invention. The side punch 600 of the present embodiment includes a cylindrical portion 602, and a protruding portion 610 which has a non-circular shape in cross section and which axially protrudes from a predetermined circumferential portion of a front end face 604 of the cylindrical portion 602, which circumferential portion is offset from the centerline of the cylindrical portion 602. The cylindrical portion 602 of the side punch 600 has a small-diameter front end portion 620 and a large-diameter rear end portion 622. An annular shoulder surface 628 is formed between the small-diameter front end portion 620 and the large-diameter rear end portion 622. The shoulder surface 628 extends radially outwardly from an outer circumferential surface 626 of the front end portion 620. The outside diameter of the annulus of the shoulder surface 628 is made larger than the outside diameter of the end face 388 of the cylindrical body portion 170. It is desirable that a fillet be formed at a boundary between the shoulder surface 628 and the outer circumferential surface 626 of the front end portion 620 for avoiding the stress concentration at the boundary. The formation of the cylindrical body portion 170 is completed when the side punch 600 has been moved to its fully advanced position at which the shoulder surface 628 of the side punch 600 is held in abutting contact with the corresponding one of sets of the side surfaces 296, 316 and the side faces 298, 318, of the first and second dies 222, 224. (In FIG. 8, only one set of the side surfaces 298, 318 are shown.)

As in the above-described first embodiment of FIGS. 1–6, the two side punches 600 are inserted into the intermediate blank in which the engaging sections 166 have been formed, with the intermediate blank being held by and between the two dies 222, 224, whereby the cylindrical body portions 170 are formed. Described in detail, the inner circumferential surface 176 and the inner bottom surface 178 of each cylindrical body portion 170 are formed by the outer circumferential surface 626 of the front end portion 620 of each side punch 600, and the front end face 604 of the cylindrical portion 602 of each side punch 600, respectively. The recess 180 is formed in the inner bottom surface 178 of each cylindrical body portion 170 by the protruding portion 610 of each side punch 600. Further, the end face 388 of the cylindrical body portion 170 is formed by the shoulder surface 628 of the side punch 600.

In the present embodiment of FIG. 8, the inner circumferential surface 176 and the inner bottom surface 178 of the cylindrical body portion 170 is formed by each side punch 600, for thereby eliminating an additional step of effecting a machining operation on those surfaces 176, 178, or reducing the number of machining steps for producing the piston blank. Further, the end face 388 of the cylindrical body portion 170 is formed by the shoulder surface 628 of each side punch 600, for thereby eliminating an additional step of effecting a machining operation to form the end face 388, or at least eliminating a step of removing a burr which would otherwise be formed on the end face 388. Even if the burr is formed on the end face 388 in the present arrangement, the burr extends radially outwardly from the radially outer edge of the end face 388 in a direction parallel to the end face 388. Accordingly, the end face 388 of the cylindrical body portion 170 is held in close contact with the corresponding end face 196 of the closing member 164, without effecting the machining operation on the end face 388 to remove the burr, resulting in reduction of the cost of manufacture of the piston blank. The burr extending radially outwardly from the radially outer edge of the end face 388 in the direction parallel to the end face 388 can be removed during the machining operation on the outer circumferential surfaces of each closing member 164 and each cylindrical body portion 170, which machining operation is effected after the closing member 164 is fixed to the cylindrical body portion 170.

FIG. 8 shows that the shoulder surface 628 of the side punch 600 is held in close contact with the side surfaces 298, 318 of the first and second dies 222, 224. Actually, the shoulder surface 628 and the side surfaces 298, 318 are held in contact with each other with a burr having a relatively small thickness interposed therebetween. In the present embodiment, the fully advanced position of each side punch 600 is determined by the abutting contact of its shoulder surface 628 with the corresponding one of the sets of the side surfaces 296, 316 and the side surfaces 298, 318, of the first and second dies 222, 224. Alternatively, there may be provided suitable stop means which is adapted to stop the advancing movement of the side punch 600 just before the side punch 600 has been brought into contact with the corresponding one of the sets of the side surfaces 296, 316 and the side surfaces 298, 318, such that a relatively small clearance is left between the shoulder surface 628 and the side surfaces 296, 316, 298, 318. In this case, there is formed a burr whose dimension corresponds to that of the clearance between the shoulder surface 628 and the side surfaces 296, 316, 298, 318.

The side punches 600 may be inserted into the forging blank in concurrent with the downward movement of the first die 222 toward the second die 224 for forming the engaging sections 166. In the illustrated embodiments, the protruding portion of each side punch may have a circular shape in transverse cross section.

Figure 9:
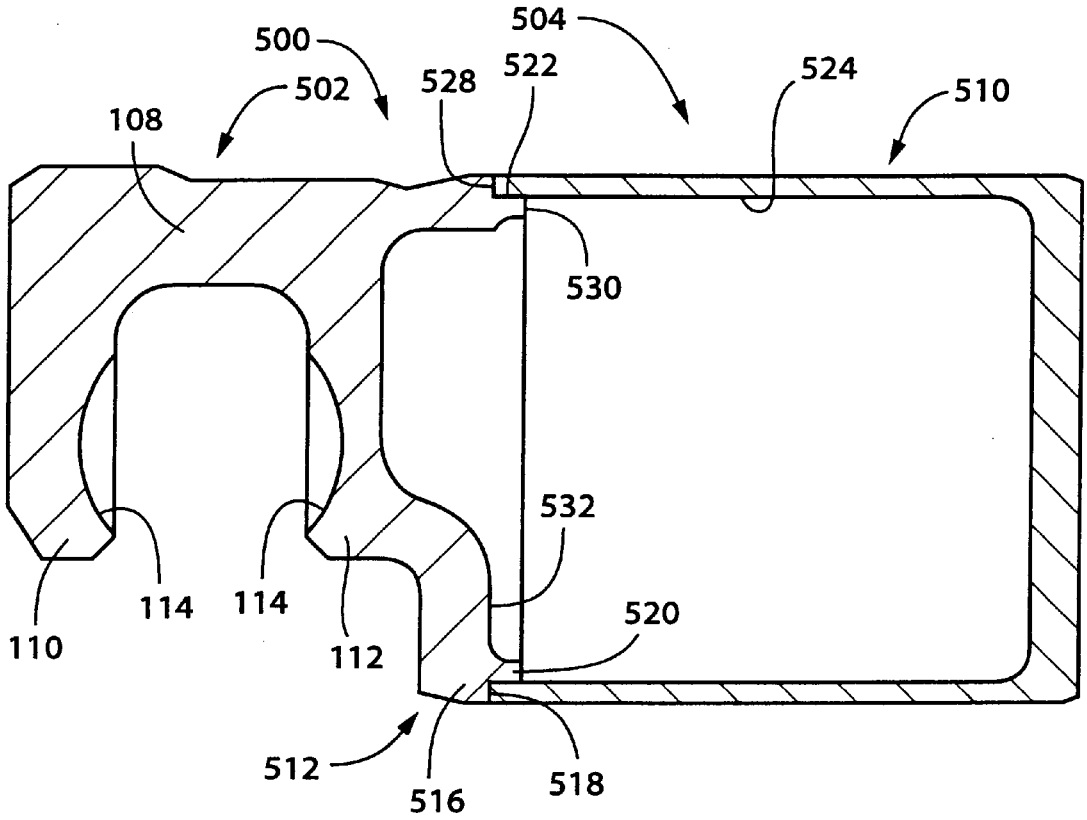
FIG. 9 is a front elevational view in cross section of a piston produced according to a fourth embodiment of the invention.

In the pistons of the illustrated embodiments of FIGS. 1–6, FIG. 7, and FIG. 8, the cylindrical body portion which constitutes a principal part of the head portion of the piston is formed integrally with the engaging portion. The principle of the present invention is applicable to a piston having other structure. FIG. 9 shows a single-headed piston 500 constructed according to a fourth embodiment of the present invention. The piston 500 includes an engaging portion 502 which is similar to the engaging portion 70 of the piston 14 of FIG. 2, and a head portion 504 which is slidably fitted in the cylinder bore 12 of the compressor. The principal part of the head portion 504 is constituted by a cylindrical body portion 510 having an open end and a closed end. The open end of the cylindrical body portion 504 is closed by a closing portion 512 as the closing member. The closing portion 512 is formed integrally with the engaging portion 502 by the forging process similar to that in the illustrated embodiments. The cylindrical body portion 510 is formed by forging separately from the integral member of the closing portion 512 and the engaging portion 502. As shown in FIG. 9, the closing portion 512 includes a bottom portion 516, and a hollow cylindrical portion 520 which extends from a radially inner portion of an end face 518 of the bottom potion 516 in the axial direction of the closing portion 512. The closing portion 512 is fixed to the cylindrical body portion 510 such that an outer circumferential surface 522 of the cylindrical portion 520 engages an inner circumferential surface 524 of the cylindrical body portion 510, and such that the end face 518 of the bottom portion 516 is held in abutting contact with an annular end face 528 of the cylindrical body portion 510 on the side of its open end, so that the end faces 518, 528 are bonded together by welding. As shown in FIG. 9, the closing portion 512 has a recess 532 formed in its end face 530 which is remote from the engaging portion 502. The recess 532 has a non-circular shape in cross section. The recess 532 is provided by a side punch in the forging process similar to that in the illustrated embodiments, for thereby eliminating an additional step of effecting a machining operation to form the recess in the end face 530 of the closing portion 512. The piston 500 whose closing portion 512 has the recess 532 which is formed by forging has an effectively reduced weight, as compared with a piston whose closing portion has a recess which is formed by machining.

The principle of the present invention is applicable to a hollow piston which is divided, at an axially intermediate portion of its head portion, into two sections, i.e., a first section having an engaging portion and a second section without the engaging portion.

The cylindrical body portion and the closing member may be bonded together by any suitable means other than the beam welding described above. For instance, the closing member is fixed to the corresponding cylindrical body portion by bonding with an adhesive agent or press-fitting. Further, the closing member may be bonded to the cylindrical body portion with an alloy having a lower melting point than those members, such as a soldering or brazing material. The closing member may be fixed to the cylindrical body portion by caulking or by means of screws. Alternatively, the closing member may be fixed to the cylindrical body portion by utilizing frictional contact or plastic material flow between the two members. These methods may be employed in combination.

In the illustrated first embodiment of FIGS. 1–6, two pieces of the single-headed 14 piston are produced from a single blank 160 wherein the two body members 162 are connected to each other at their ends on the side of their engaging sections 166. The two body members 162 of the blank 160 may be connected to each other at their ends on the side of their head sections. Further, a single piston may be produced from a blank which includes one body member and one closing member.

At least one of the cylindrical body portion and the closure member of the piston may be formed of other metallic material such as a magnesium alloy. Where the cylindrical body portion and the closure member are fixed together by bonding or caulking, the closure member may be formed of a resin material suitable for bonding or caulking.

The construction of the swash plate type compressor for which the pistons 14, 400, 500 according to the present invention are incorporated is not limited to that of FIG. 1. For instance, the capacity control valve 90 is not essential, and the compressor may use a shut-off valve which is mechanically opened and closed depending upon a difference between the pressures in the crank chamber 86 and the discharge chamber 24. In place of or in addition to the capacity control valve 90, a solenoid-operated control valve similar to the capacity control valve 90 may be provided in the bleeding passage 100. Alternatively, a shut-off valve may be provided, which is mechanically opened or closed depending upon a difference between the pressures in the crank chamber 86 and the suction chamber 22.

The principle of the present invention is applicable to a double-headed piston having two head portions on the opposite sides of the engaging portion which engages the swash plate. The pistons in the illustrated embodiments may be used in a swash plate type compressor of fixed capacity type wherein the inclination angle of the swash plate is fixed.

While the presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A method of producing a hollow piston for a compressor, the piston including at least one head portion which is slidably fitted in a cylinder bore of the compressor and an engaging portion which engages a reciprocating drive device of the compressor for reciprocating the piston, at least said at least one head portion being hollow, said method comprising the steps of:

placing a forging blank between two first dies;

moving said two first dies relatively toward each other along a first axis;

moving at least one second die from a retracted position toward an advanced position along a second axis which is perpendicular to said first axis;

moving said two first dies relatively away from each other and moving said at least one second die from said advanced position to said retracted position so that a piston blank which has been forged is removed, said piston blank including an engaging-portion-forming section which provides said engaging portion of the piston, and at least one head-portion-forming section which provides at least a part of said at least one head portion of the piston; and fixing a closing member to said at least one head-portion-forming section of said piston blank so as to provide the piston.

2. A method according to claim 1, wherein said first axis along which said two first dies are moved is perpendicular to an axial direction of said piston blank so that said engaging-portion-forming section is formed by said two first dies, while said second axis along which said at least one second die is moved is parallel to said axial direction so that said at least one head-portion-forming section is formed by said at least one second die.

3. A method according to claim 2, wherein said at least one second die consists of at least one side punch, and said step of moving at least one second die comprises inserting said at least one side punch into an intermediate blank, which is formed by forming said engaging-portion-forming section by forging with said two first dies, so as to form, by forging, said at least one head-portion-forming section.

4. A method according to claim 3, wherein said at least one side punch includes a cylindrical portion, and a protruding portion which protrudes from a front end face of said cylindrical portion in the axial direction thereof and which has a non-circular shape in transverse cross section.

5. A method according to claim 3, wherein said at least one side punch includes a cylindrical portion, and a protruding portion which protrudes from a front end face of said cylindrical portion and which is offset from the centerline of said cylindrical portion.

6. A method according to claim 3, wherein said at least one head-portion-forming section includes a cylindrical body portion which has a hollow cylindrical section having an open end and a closed end, and a bottom portion which defines said closed end, and said at least one side punch includes a cylindrical portion having an outer circumferential surface for forming an inner circumferential surface of said cylindrical body portion, and an annular shoulder surface which extends radially outwardly from said outer circumferential surface of said cylindrical portion, for forming an annular end face of said hollow cylindrical section, which end face is remote from said bottom portion.

7. A method according to claim 6, wherein said annular shoulder surface of said at least one side punch has an outside diameter which is larger than that of said annular end face of said hollow cylindrical section.

8. A method according to claim 7, wherein said step of fixing a closing member to said at least one head-portion-forming section of said piston blank comprises fixing said closing member to said cylindrical body portion of said at least one head-portion-forming section to close said open end of said hollow cylindrical section of said cylindrical body portion, such that said annular end face of said hollow cylindrical section is held in close contact with an end face of said closing member.

9. A method according to claim 8, wherein said closing member includes a fitting portion which extends from said end face thereof, said closing member being fixed to said cylindrical body portion such that said end face of said closing member is held in close contact with said annular end face of said hollow cylindrical section of said cylindrical body portion, and such that said fitting portion of said closing member is inserted into said open end of said hollow cylindrical section of said cylindrical body portion.

10. A method according to claim 2, wherein said engaging portion includes a pair of parallel arm sections which engage opposite surfaces of a swash plate of said reciprocating drive device at a radially outer portion thereof through a pair of shoes, and a base section which connects proximal ends of said arm sections, and said two first dies are movable toward and away from each other in opposite directions parallel to a direction in which said arm sections extend from said base section.

11. A method according to claim 10, wherein one of said two first dies is a movable die having a forming surface which gives said arm sections and which is movable toward and away from the other of said two first dies which is a stationary die.

12. A method according to claim 1, wherein said at least one head-portion-forming section which provides at least a part of said at least one head portion of the piston is formed by forging as a cylindrical body portion that gives a principal part of said at least one head portion of the piston.

13. A method according to claim 1, wherein said at least one head-portion-forming section which provides at least a part of said at least one head portion of the piston is formed by forging as a closure member which closes an open end of a cylindrical body portion that gives a principal part of said at least one head portion of the piston.

14. A method of producing a hollow piston for a compressor, the piston including at least one head portion which is slidably fitted in a cylinder bore of the compressor and an engaging portion which engages a reciprocating drive device of the compressor for reciprocating the piston, at least said at least one head portion being hollow, said method comprising the steps of:

placing a forging blank between two first dies;

moving said two first dies relatively toward each other along a first axis while moving at least one second die from a retracted position toward an advanced position along a second axis which is perpendicular to said first axis;

moving said two first dies relatively away from each other and moving said at least one second die from said advanced position to said retracted position so that a piston blank which has been forged is removed, said piston blank including an engaging-portion-forming section which provides said engaging portion of the piston, and at least one head-portion-forming section which provides at least a part of said at least one head portion of the piston; and fixing a closing member to said at least one head-portion-forming section of said piston blank so as to provide the piston.

15. A method according to claim 14, wherein said first axis along which said two first dies are moved is perpendicular to an axial direction of said piston blank so that said engaging-portion-forming section is formed by said two first dies, while said second axis along which said at least one second die is moved is parallel to said axial direction so that said at least one head-portion-forming section is formed by said at least one second die.

16. A method according to claim 15, wherein said at least one second die consists of at least one side punch, and said step of moving at least one second die comprises inserting said at least one side punch into said forging blank, so as to form, by forging, said at least one head-portion-forming section.

17. A method according to claim 16, wherein said at least one side punch includes a cylindrical portion, and a protruding portion which protrudes form a front end face of said cylindrical portion in the axial direction thereof and which has a non-circular shape in transverse cross section.

18. A method according to claim 16, wherein said at least one side punch includes a cylindrical portion, and a protruding portion which protrudes from a front end face of said cylindrical portion and which is offset from the centerline of said cylindrical portion.

19. A method according to claim 16, wherein said at least one head-portion-forming section includes a cylindrical body portion which has a hollow cylindrical section having an open end and a closed end, and a bottom portion which defines said closed end, and said at least one side punch includes a cylindrical portion having an outer circumferential surface for forming an inner circumferential surface of said cylindrical body portion, and an annular shoulder surface which extends radially outwardly from said outer circumferential surface of said cylindrical portion, for forming an annular end face of said hollow cylindrical section, which end face is remote from said bottom portion.

20. A method according to claim 19, wherein said annular shoulder surface of said at least one side punch has an outside diameter which is larger than that of said annular end face of said hollow cylindrical section.

21. A method according to claim 20, wherein said step of fixing a closing member to said at least one head-portion-forming section of said piston blank comprises fixing said closing member to said cylindrical body portion of said at least one head-portion-forming section to close said open end of said hollow cylindrical section of said cylindrical body portion, such that said annular end face of said hollow cylindrical section is held in close contact with an end face of said closing member.

22. A method according to claim 21, wherein said closing member includes a fitting portion which extends from said end face thereof, said closing member being fixed to said cylindrical body portion such that said end face of said closing member is held in close contact with said annular end face of said hollow cylindrical section of said cylindrical body portion, and such that said fitting portion of said closing member is inserted into said open end of said hollow cylindrical section of said cylindrical body portion.

23. A method according to claim 14, wherein said engaging portion includes a pair of parallel arm sections which engage opposite surfaces of a swash plate of said reciprocating drive device at a radially outer portion thereof through a pair of shoes, and a base section which connects proximal ends of said arm sections, and said two first dies are movable toward and away from each other in opposite directions parallel to a direction in which said arm sections extend from said base section.

24. A method according to claim 23, wherein one of said two first dies is a movable die having a forming surface which gives said arm sections and which is movable toward and away from the other of said two first dies which is a stationary die.

25. A method according to claim 14, wherein each of said at least one head-portion-forming section which provides at least a part of said at least one head portion of the piston is formed by forging as a cylindrical body portion that gives a principal part of said at least one head portion of the piston.

26. A method according to claim 14, wherein said at least one head-portion-forming section which provides at least a part of said at least one head portion of the piston is formed by forging as a closure member which closes an open end of a cylindrical body portion that gives a principal part of said at least one head portion of the piston.

27. A method of producing a piston blank for at least one hollow piston used for a compressor, the piston including at least one head portion which is slidably fitted in a cylinder bore of the compressor and an engaging portion which engages a reciprocating drive device of the compressor for reciprocating the piston, at least said at least one head portion being hollow, said method comprising the steps of:

placing a forging blank between two first dies;

moving said two first dies relatively toward each other along a first axis;

moving at least one second die from a retracted position toward an advanced position along a second axis which is perpendicular to said first axis; and moving said two first dies relatively away from each other and moving said at least one second die from said advanced position to said retracted position so that a piston blank which has been forged is removed, said piston blank including an engaging-portion-forming section which provides said engaging portion of the piston, and at least one head-portion-forming section which provides at least a part of said at least one head portion of the piston.

28. A method of producing a piston blank for at least one hollow piston used for a compressor, the piston including at least one head portion which is slidably fitted in a cylinder bore of the compressor and an engaging portion which engages a reciprocating drive device of the compressor for reciprocating the piston, at least said at least one head portion being hollow, said method comprising the steps of:

placing a forging blank between two first dies;

moving said two first dies relatively toward each other along a first axis while moving at least one second die from a retracted position toward an advanced position along a second axis which is perpendicular to said first axis; and moving said two first dies relatively away from each other and moving said at least one second die from said advanced position to said retracted position so that a piston blank which has been forged is removed, said piston blank including an engaging-portion-forming section which provides said engaging portion of the piston, and at least one head-portion-forming section which provides at least a part of said at least one head portion of the piston.

* * * * *